US007604915B2

(12) United States Patent
Chung et al.

(10) Patent No.: US 7,604,915 B2
(45) **Date of Patent: *Oct. 20, 2009**

(54) TONER COMPOSITIONS HAVING MAGENTA PIGMENT

(75) Inventors: Joo T. Chung, Webster, NY (US); Scott M. Silence, Fairport, NY (US); Julia Kohlmeier, Penfield, NY (US); John Ianni, Medina, NY (US)

(73) Assignee: Xerox Corporation, Norwalk, CT (US)

( * ) Notice: Subject to any disclaimer, the term of this patent is extended or adjusted under 35 U.S.C. 154(b) by 525 days.

This patent is subject to a terminal disclaimer.

(21) Appl. No.: 11/508,365

(22) Filed: Aug. 23, 2006

(65) Prior Publication Data

US 2008/0050668 A1 Feb. 28, 2008

(51) Int. Cl.
*G03G 9/08* (2006.01)

(52) U.S. Cl. ..... 430/108.4; 430/108.1; 430/111.41; 430/137.2

(58) Field of Classification Search ..... 430/108.1, 430/108.4, 137.2
See application file for complete search history.

(56) References Cited

U.S. PATENT DOCUMENTS

| | | | | |
|---|---|---|---|---|
| 5,556,727 | A | 9/1996 | Ciccarelli et al. | |
| 6,326,119 | B1 | 12/2001 | Hollenbaugh, Jr. et al. | |
| 6,365,316 | B1 | 4/2002 | Stamp et al. | |
| 6,824,942 | B2 | 11/2004 | Silence et al. | |
| 6,850,725 | B2 | 2/2005 | Silence et al. | |
| 2006/0083999 | A1 * | 4/2006 | Ishimoto et al. | 430/108.1 |

FOREIGN PATENT DOCUMENTS

JP 10104881 A * 4/1998

OTHER PUBLICATIONS

English language translation of JP 10-104881 (Apr. 1998).*
Diamond, Arthur S & David Weiss (eds.) Handbook of Imaging Materials, 2nd ed.. New York: Marcel-Dekker, Inc. (Nov. 2001) pp. 145-164, 180, and 181.*

* cited by examiner

*Primary Examiner*—Christopher RoDee
(74) *Attorney, Agent, or Firm*—Pillsbury Winthrop Shaw Pittman LLP

(57) ABSTRACT

Use of a charge control agent in a toner, such as a magenta toner, to give an increased triboelectric charge is disclosed. The magenta toner may contain a magenta resin, such as xanthene. The charge control agent is a styrene-acrylate polymer, such as the following polymer of Formula II:

Formula II

22 Claims, 4 Drawing Sheets

TONER COMPOSITIONS HAVING MAGENTA PIGMENT

TECHNICAL FIELD

The presently disclosed embodiments are generally directed to toner compositions that include a charge control agent as an additive. More specifically, the presently disclosed embodiments are directed to toner compositions that include a polymeric internal charge control agent as an additive to boost triboelectric effect.

BACKGROUND

Electrophotography, which is a method for visualizing image information by forming an electrostatic latent image, is currently employed in various fields. The term "electrostatographic" is generally used interchangeably with the term "electrophotographic." In general, electrophotography comprises the formation of an electrostatic latent image on a photoreceptor, followed by development of the image with a developer containing a toner, and subsequent transfer of the image onto a transfer material such as paper or a sheet, and fixing the image on the transfer material by utilizing heat, a solvent, pressure and/or the like to obtain a permanent image.

During the development stage of electrophotography, as toner is magnetically attracted to the magnetic development roller, a negative charge build up is caused on the individual toner particles. This is called the triboelectric charge. Since both the toner and roller are charged negatively, the toner is repelled towards the positively charged areas of the drum to create the latent image. The negatively charged areas of the drum also repel toner, leaving only the image on the drum in dusted toner particles.

In electrostatographic reproducing apparatuses, including digital, image on image, and contact electrostatic printing apparatuses, a light image of an original to be copied is typically recorded in the form of an electrostatic latent image upon a photosensitive member and the latent image is subsequently rendered visible by the application of electroscopic thermoplastic resin particles and pigment particles, or toner. Electrophotographic imaging members may include photosensitive members (photoreceptors) which are commonly utilized in electrophotographic (xerographic) processes, in either a flexible belt or a rigid drum configuration. Other members may include flexible intermediate transfer belts that are seamless or seamed, and usually formed by cutting a rectangular sheet from a web, overlapping opposite ends, and welding the overlapped ends together to form a welded seam. These electrophotographic imaging members comprise a photoconductive layer comprising a single layer or composite layers.

When the triboelectric charge of a toner is low, a number of issues occur in electrophotography using that toner. For example, there may be color spittings during development (e.g., toner particles accumulate at baffle and nips between the roll and edge of housing of the machine during printing and release them suddenly during printing marking undesirable large marks on prints), low developer life, and background (e.g., spots caused by individual particles that you see on the permanent image) on the final image. These issues can be magnified when a toner's triboelectric charge decreases with age. These issues are more prevalent with magenta developer, because triboelectric charge is generally lower than for other colors. External additives have been used to minimize these issues, but it has previously not been possible to increase the triboelectric charge of magenta developer to that of other colors. Previous attempts to sue an internal charge control agent have not been effective, because magenta toner is often itself a powerful charge control agent. Thus, the use of large quantities of external additives, the majority of the additives being negatively charging silica, are generally required to yield a functional magenta toner design.

BRIEF SUMMARY

According to embodiments illustrated herein, there is provided a pigment for a charge generating layer that addresses the shortcomings discussed above.

An embodiment may include a toner comprising resin; magenta pigment; and an internal charge control agent having the formula:

Formula II

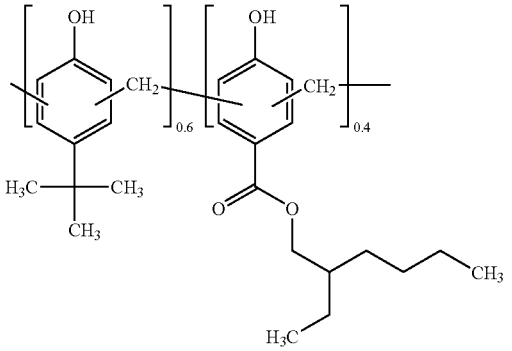

In another embodiment, there is provided a toner comprising resin; magenta pigment, wherein the magenta pigment is a xanthene pigment; and an internal charge control agent having the formula:

Formula II

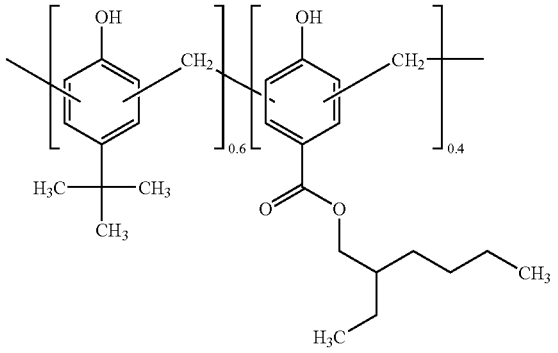

wherein the triboelectric charge of the toner is at least about 10 μC/g when the toner environment has a relative humidity of about 10% or more at about 70° F.

In another embodiment, there is provided a method of making a toner comprising admixing resin, magenta pigment, and an internal charge control agent having the formula:

Formula II

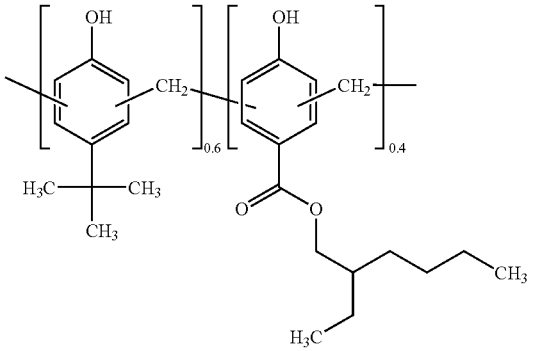

grinding the mixture; and classifying the ground mixture.

DETAILED DESCRIPTION

Figure 1:
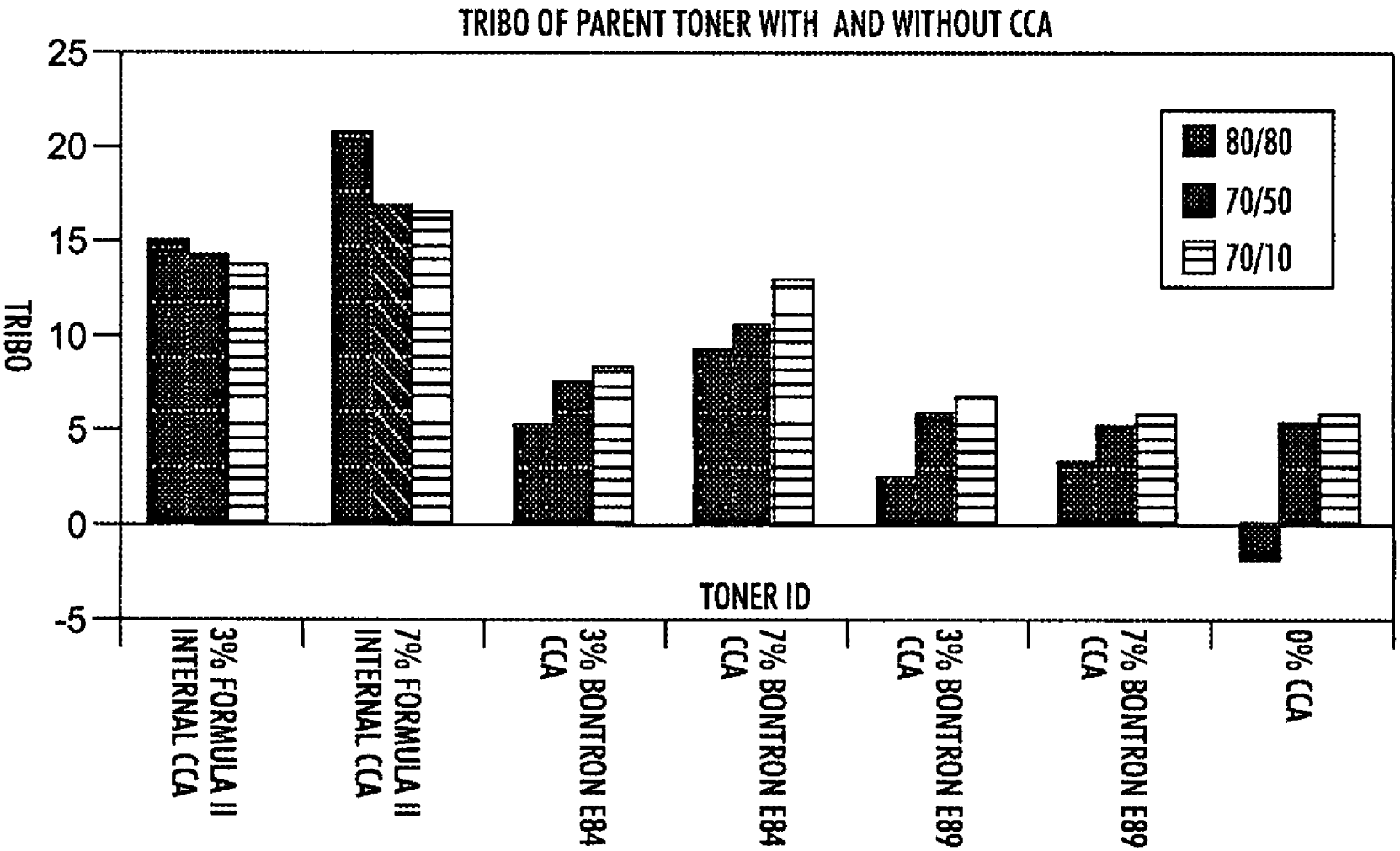
FIG. 1 is a graph of experimental data showing the triboelectric charge of embodiments of parent toners at several ranges of relative humidity and temperature.

In the following description, it is understood that other embodiments may be used and structural and operational changes may be made without departing from the scope of the present disclosure.

The present embodiments relate to the addition of a charge control agent to toner compositions. Specifically, the present embodiments relate to the addition of an acryl base polymeric charge control agent, which has negative polarity, and which may be incorporated with other toner components to improve triboelectric charge of a toner.

In embodiments, the toner can comprise a resin, wax, colorant, and optional additives such as a charge control agent. Such toners are disclosed in, for example, U.S. Pat. Nos. 6,326,119; 6,365,316; 6,824,942 and 6,850,725, the disclosures of which are hereby incorporated by reference in their entireties. The toner will be described below:

Resin

The toner resin can be a partially crosslinked unsaturated resin such as unsaturated polyester prepared by crosslinking a linear unsaturated resin (hereinafter called base resin), such as linear unsaturated polyester resin, in embodiments, with a chemical initiator, through a reactive extrusion in a melt mixing device such as, for example, an extruder at high temperature (e.g., above the glass transition temperature of the resin, and more specifically, up to about 150° C. above that glass transition temperature) and under high shear. Also, the toner resin possesses, for example, a weight fraction of the microgel (gel content) in the resin mixture of from about 0.001 to about 50 weight percent, from about 1 to about 20 weight percent, or about 1 to about 10 weight percent, or from about 2 to about 9 weight percent. The linear portion is comprised of base resin, more specifically unsaturated polyester, in the range of from about 50 to about 99.999 percent by weight of the toner resin, or from about 80 to about 98 percent by weight of the toner resin. More specifically, the range may be between about 81.6 and 67.1% by weight of linear portion of the resin and between about 7.5 and 18% by weight of the cross-linked resin portion. The linear portion of the resin may comprise low molecular weight reactive base resin that did not crosslink during the crosslinking reaction, more specifically unsaturated polyester resin.

The molecular weight distribution of the resin is thus bimodal having different ranges for the linear and the crosslinked portions of the binder. The number average molecular weight ($M_n$) of the linear portion as measured by gel permeation chromatography (GPC) is from, for example, about 1,000 to about 20,000, or from about 3,000 to about 8,000. The weight average molecular weight ($M_w$) of the linear portion is from, for example, about 2,000 to about 40,000, or from about 5,000 to about 20,000. The weight average molecular weight of the gel portions is greater than 1,000,000. The molecular weight distribution ($M_w/M_n$) of the linear portion is from about 1.5 to about 6, or from about 1.8 to about 4. The onset glass transition temperature (Tg) of the linear portion as measured by differential scanning calorimetry (DSC) is from about 50° C. to about 70° C.

The resin includes between about 5% and about 10% by weight of magenta pigment and between about 3% and about 7% by weight of charge control agent.

Moreover, the binder resin, especially the crosslinked polyesters, can provide a low melt toner with a minimum fix temperature of from about 100° C. to about 200° C., or from about 100° C. to about 160° C., or from about 110° to about 140° C.; provide the low melt toner with a wide fusing latitude to minimize or prevent offset of the toner onto the fuser roll; and maintain high toner pulverization efficiencies. The toner resins and thus toners, show minimized or substantially no vinyl or document offset.

Examples of unsaturated polyester base resins are prepared from diacids and/or anhydrides such as, for example, maleic anhydride, fumaric acid, and the like, and mixtures thereof, and diols such as, for example, propoxylated bisphenol A, propylene glycol, and the like, and mixtures thereof. An example of a suitable polyester is poly(propoxylated bisphenol A fumarate).

In embodiments, the toner binder resin is generated by the melt extrusion of (a) linear propoxylated bisphenol A fumarate resin, and (b) crosslinked by reactive extrusion of the linear resin with the resulting extrudate comprising a resin with an overall gel content of from about 2 to about 9 weight percent. Linear propoxylated bisphenol A fumarate resin is available under the trade name SPAR II™ from Resana S/A Industrias Quimicas, Sao Paulo Brazil, or as NEOXYL P2294™ or P2297™ from DSM Polymer, Geleen, The Netherlands, for example. For suitable toner storage and prevention of vinyl and document offset, the polyester resin blend more specifically has a Tg range of from, for example, about 52° C. to about 64° C.

Chemical initiators, such as, for example, organic peroxides or azo-compounds, can be used for the preparation of the crosslinked toner resins.

The low melt toners and toner resins may be prepared by a reactive melt mixing process wherein reactive resins are partially crosslinked. For example, low melt toner resins may be fabricated by a reactive melt mixing process comprising (1) melting reactive base resin, thereby forming a polymer melt, in a melt mixing device; (2) initiating crosslinking of the polymer melt, more specifically with a chemical crosslinking initiator and increased reaction temperature; (3) retaining the polymer melt in the melt mixing device for a sufficient residence time that partial crosslinking of the base resin may be achieved; (4) providing sufficiently high shear during the crosslinking reaction to keep the gel particles formed and broken down during shearing and mixing, and well distributed in the polymer melt; (5) optionally devolatilizing the polymer melt to remove any effluent volatiles; and (6) optionally adding additional linear base resin after the crosslinking in order to achieve the desired level of gel content in the end resin. The high temperature reactive melt mixing process allows for very fast crosslinking which enables the production of substantially only microgel particles, and the high shear of the process prevents undue growth of the microgels and enables the microgel particles to be uniformly distributed in the resin.

A reactive melt mixing process is, for example, a process wherein chemical reactions can be affected on the polymer in the melt phase in a melt-mixing device, such as an extruder. In preparing the toner resins, these reactions are used to modify the chemical structure and the molecular weight, and thus the melt rheology and fusing properties of the polymer. Reactive melt mixing is particularly efficient for highly viscous materials, and is advantageous because it requires no solvents, and thus is easily environmentally controlled. Continuous reactive melt mixing process produces reactive material with desired degree of crosslinking. The extruded crosslinked material then quenches to maintain morphology as the material comes out of the extruder.

The resin is present in the toner in an amount of from about 40 to about 98 percent by weight, or from about 70 to about 98 percent by weight. The resin can be melt blended or mixed with a colorant, internal charge control agents, additives, pigment, pigment dispersants, flow additives, embrittling agents, and the like. The resultant product can then be micronized by known methods, such as milling or grinding, to form the desired toner particles.

Waxes

Waxes with, for example, a low molecular weight $M_w$ of from about 1,000 to about 10,000, such as polyethylene, polypropylene, and paraffin waxes, can be included in, or on the toner compositions as, for example, fusing release agents.

Colorants

Various suitable colorants of any color can be present in the toners, including suitable colored pigments, dyes, and mixtures thereof including REGAL 330®; (Cabot), Acetylene Black, Lamp Black, Aniline Black; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like; cyan, magenta, yellow, red, green, brown, blue or mixtures thereof, such as specific phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colored pigments and dyes that can be selected are cyan, magenta, or yellow pigments or dyes, and mixtures thereof. Examples of magentas that may be selected include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Other colorants are magenta colorants of (Pigment Red) PR81:2, CI 45160:3. Illustrative examples of cyans that may be selected include copper tetra(octadecyl sulfonamido) phthalocyanine, x-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellows that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Forum Yellow SE/GLN, Cl Dispersed Yellow 33 2,5-dimethoxy-4-sulfonanilide phenylazo-4-chloro-2,5-dimethoxy acetoacetanilides, and Permanent Yellow FGL, PY17, CI 21105, and known suitable dyes, such as red, blue, green, Pigment Blue 15:3 C.I. 74160, Pigment Red 81:3 C.I. 45160:3, and Pigment Yellow 17 C.I. 21105, and the like, reference for example U.S. Pat. No. 5,556,727, the disclosure of which is totally incorporated herein by reference.

The colorant, more specifically black, cyan, magenta and/or yellow colorant, is incorporated in an amount sufficient to impart the desired color to the toner. In general, pigment or dye is selected, for example, in an amount of from about 2 to about 60 percent by weight, or from about 2 to about 9 percent by weight for color toner, and about 3 to about 60 percent by weight for black toner.

In further embodiments, the toner is a magenta toner, which includes magenta pigment particles, for example, xanthene pigments. Xanthene pigments are a silicomolybdic acid salt of Formula I:

Formula I

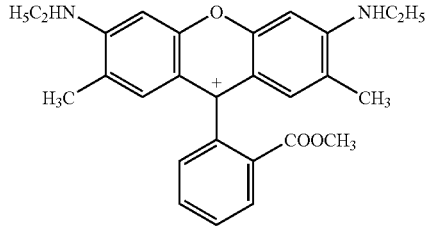

Additives

Any suitable surface additives may be selected. Examples of additives are surface treated fumed silicas, for example TS-530 from Cabosil Corporation, with an 8 nanometer particle size and a surface treatment of hexamethyldisilazane; NAX50 silica, obtained from DeGussa/Nippon Aerosil Corporation, coated with HMDS; DTMS silica, obtained from Cabot Corporation, comprised of a fumed silica silicon dioxide core L90 coated with DTMS; H2050EP, obtained from Wacker Chemie, coated with an amino functionalized organopolysiloxane; metal oxides such as $TiO_2$, for example MT-3103 from Tayca Corp. with a 16 nanometer particle size and a surface treatment of decylsilane; SMT5103, obtained from Tayca Corporation, comprised of a crystalline titanium dioxide core MT500B coated with DTMS; P-25 from Degussa Chemicals with no surface treatment; alternate metal oxides such as aluminum oxide, and as a lubricating agent, for example, stearates or long chain alcohols, such as UNILIN 700™, and the like. In general, silica is applied to the toner surface for toner flow, tribo enhancement, admix control, improved development and transfer stability, and higher toner blocking temperature. $TiO_2$ is applied for improved relative humidity (RH) stability, tribo control and improved development and transfer stability.

The $SiO_2$ and $TiO_2$ should more specifically possess a primary particle size greater than approximately 30 nanometers, or at least 40 nanometers, with the primary particles size measured by, for instance, transmission electron microscopy (TEM) or calculated (assuming spherical particles) from a measurement of the gas absorption, or BET, surface area. $TiO_2$ is found to be especially helpful in maintaining development and transfer over a broad range of area coverage and job run length. The $SiO_2$ and $TiO_2$ are more specifically applied to the toner surface with the total coverage of the toner ranging from, for example, about 140 to about 200 percent theoretical surface area coverage (SAC), where the theoretical SAC (hereafter referred to as SAC) is calculated assuming all toner particles are spherical and have a diameter equal to the volume median diameter of the toner as measured in the standard Coulter Counter method, and that the additive particles are distributed as primary particles on the toner surface in a hexagonal closed packed structure. Another metric relating to the amount and size of the additives is the sum of the "SAC×Size" (surface area coverage times the primary particle size of the additive in nanometers) for each of the silica and titania particles, or the like, for which all of the additives should, more specifically, have a total SAC×Size range of, for example, about 4,500 to about 7,200. The ratio of the silica to titania particles is generally from about 50 percent silica/50 percent titania to about 85 percent silica/15 percent titania (on a weight percentage basis).

Examples of suitable $SiO_2$ and $TiO_2$ are those surface treated with compounds including DTMS (decyltrimethoxysilane) or HMDS (hexamethyldisilazane). Examples of these additives are NAX50 silica, obtained from DeGussa/Nippon Aerosil Corporation, coated with HMDS; DTMS silica, obtained from Cabot Corporation, comprised of a fumed silica, for example silicon dioxide core L90 coated with DTMS; H2050EP, obtained from Wacker Chemie, coated with an amino functionalized organopolysiloxane; and SMT5103, obtained from Tayca Corporation, comprised of a crystalline titanium dioxide core MT500B, coated with DTMS.

Calcium stearate and zinc stearate can be selected as an additive for the toners of the present invention in embodiments thereof, the calcium and zinc stearate primarily providing lubricating properties. Also, the calcium and zinc stearate can provide developer conductivity and tribo enhancement, both due to its lubricating nature. In addition, calcium and zinc stearate enables higher toner charge and charge stability by increasing the number of contacts between toner and carrier particles. A suitable example is a commercially available calcium and zinc stearate with greater than about 85 percent purity, for example from about 85 to about 100 percent pure, for the 85 percent (less than 12 percent calcium oxide and free fatty acid by weight, and less than 3 percent moisture content by weight) and which has an average particle diameter of about 7 microns and is available from Ferro Corporation (Cleveland, Ohio). Examples are SYNPRO® Calcium Stearate 392A and SYNPRO® Calcium Stearate NF Vegetable or Zinc Stearate-L. Another example is a commercially available calcium stearate with greater than 95 percent purity (less than 0.5 percent calcium oxide and free fatty acid by weight, and less than 4.5 percent moisture content by weight), and which stearate has an average particle diameter of about 2 microns and is available from NOF Corporation (Tokyo, Japan). In embodiments, the toners contain from, for example, about 0.1 to about 5 weight percent titania, about 0.1 to about 8 weight percent silica, or from about 0.1 to about 4 weight percent calcium or zinc stearate.

The toner composition can be prepared by a number of known methods including melt mixing the toner resin particles, and pigment particles or colorants, followed by mechanical attrition. Other methods include those well known in the art such as melt dispersion, dispersion polymerization, suspension polymerization, extrusion, and emulsion/aggregation processes.

The resulting toner particles can then be formulated into a developer composition. The toner particles can be mixed with carrier particles to achieve a two-component developer composition.

In embodiments, a charge control agent is added. In further embodiments, the charge control agent is an internal charge control agent, such as an acryl base polymeric charge control agent. In more specific embodiments the charge control agent is a styrene-acrylate polymer, such as the following polymer of Formula II:

Formula II

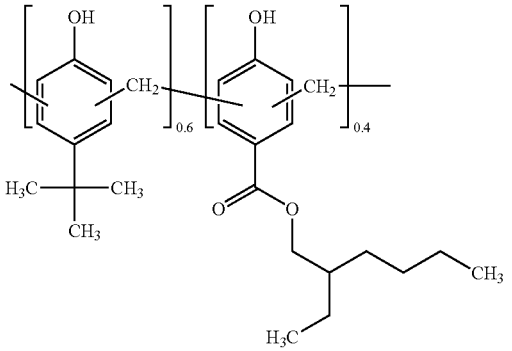

In particular embodiments, the toner contains between about 3% and 7% by weight of internal charge control agent, for example, Formula II charge control agent. The toner may contain between about 7.5% and about 18% by weight of crosslinked resin, about 7.9% by weight of xanthene pigment, and between about 81.6% and about 67.1% by weight linear resin. For example, one toner composition could include about 3% by weight of internal charge control agent, about 7.5% of cross-linked resin, about 7.9% of xanthene pigment, and about 81.6% of linear resin. Another composition could include about 7% by weight of internal charge control agent, about 18% by weight of crosslinked resin, about 7.9% by weight of xanthene pigment, and about 67.1% by weight of linear resin.

The above charge control agent effectively raises the triboelectric charge of a parent toner particle, which is classified toner before blended with external additives, and gives the parent particle a triboelectric charge dependence with relative humidity ("RH") that is opposite in direction to what is usually observed. In other words, the toner with charge control agent displayed decreasing triboelectric charge as relative humidity increases.

In embodiments, the triboelectric charge of the toner is equal to or greater than about 10 μC/g at 10% relative humidity or higher at 70° F. In further embodiments, the triboelectric charge of the toner is equal to or greater than about 15 μC/g at 80% relative humidity or higher at 80° F. In further embodiments, when the amount of charge control agent is at least about 7% by weight of the toner, the triboelectric charge of the toner is equal to or greater than about 15 μC/g at 10% relative humidity or higher at 70° F. and is equal to or greater than about 20 μC/g at 80% relative humidity or higher at 80° F.

In embodiments, the triboelectric charge of the toner does not decrease below 10 μC/g after at least 60 minutes of paint shaking. This is more than 5 μC/g above tested toners with other charge control agents, and more than 10 μC/g about the same toner without any charge control agent.

In embodiments, the triboelectric charge of the toner is stable as it ages, in contrast to tested toners with other internal charge control agents, and the same toners without any internal charge control agent. Triboelectric charge of the toner embodiments according to the present disclosure is relatively flat, and toners with other internal charge control agents and the same toners without internal control agents increase over time.

In embodiments, there is substantially no effect on the color of the amount of charge control agent added into the toner. This may be shown by a lightness versus chroma test, which would show that the amount of charge control agent added does not substantially affect the results.

The toner may be made by admixing resin, wax, the pigment/colorant, and the charge control agent. In embodiments, the charge control agent is the charge control agent of Formula II and the pigment is a magenta pigment, such as xanthene. The admixing may be done in an extrusion device. The extrudate may then be ground, for example in a jet mill, followed by classification to provide a magenta toner having a desired volume average particle size, for example about 8.3±0.4 microns. The classified toner is blended with external additives, which are specifically formulated in a Henschel blender and subsequently screening out the beads the toner through a screen, such as a 37 micron screen, to eliminate coarse particles or agglomerate of additives.

EXAMPLES

The examples set forth herein below and are illustrative of different compositions and conditions that can be used in practicing the present embodiments. All proportions are by weight unless otherwise indicated. It will be apparent, however, that the present embodiments can be practiced with many types of compositions and can have many different uses in accordance with the disclosure above and as pointed out hereinafter.

Testing of Toners with and without Charge Control Agent

Several toners were tested, some without a charge control agent and some with an internal charge control agent, including the internal charge control agent of Formula II above. Specifically, two parent/control toners (i.e., classified toners without any external additives) were tested. The toners contained 7.5 and 18% by weight of a cross-linked resin, which partially cross-linked of linear polyester resin through radical polymerization on a twin screw extruder, 7.9% by weight of magenta pigment xanthene, and the remainder, 81.6 and 67.1% by weight, of Polyester linear resin.

The toners were made by melt mix process, which mix all the component materials such as 7.5% and 18% of Polyester crosslinked resin, 7.9% pigment concentration, 3 and 7% charge control agent and 81.6% and 67.1% Polyester linear resin for 3% and 7% charge control agent respectively in molten state using a twin screw extruder. Extruded toner was ground in the "Grinding" unit operation and micronized to a particle size specification of 7.9±0.3 microns. The ground toner then went to the next unit operation "Classification." This operation classified particles based on size specification to 8.3±0.4 microns by separation of fine and coarse particles. Parent toner is as a classified toner (prior to blending with external additives), which unit operation ends at "Classification." A non-parent toner is a toner blended with external additives after classification, also called "blend" toner. The blended toner then went through a screen to separate agglomerates and large particles from the blending process.

The toners with charge control agents contained 3.0, 5.0 and 7.0% by weight of charge control agents. The charge control agents were BONTRON E89 (available from Orient Chem), BONTRON E84 (available from Orient Chem in Japan), and the Formula II charge control agent. The internal charge control agents were melt mixed with the formula of the parent toner, with a respective lowering of the amount of linear resin added based on internal charge control agent concentration.

The data shown in FIG. 1 are triboelectric charges of parent toners without and with charge control agent triboelectric charges, using the standard carrier (Ferrite coated with polymethylmethacrylate (pMMA)) at bench characterization conditions (20 minute paint shake) in 3 temperature/relative humidity (RH) conditions: A-zone (80° F./80% RH); B-zone (70° F./50% RH); and J-zone (70° F./10% RH). The material on the far right is the parent toner without charge control agent, 7.9% xanthene and no internal charge control agent. The triboelectric charge in B- and J-zones is very low (about 5 μC/g) and the triboelectric charge in the A-zone is actually slightly negative (using the convention of referencing the carrier triboelectric charge, which is opposite in sign to the toner triboelectric charge). The remainder of the toners contain internal charge control agents, with the types and levels as indicated in the figure. All were prepared using compounding (extrusion), micronization, and classification processes as described above. At the levels of charge control agents explored, BONTRON E89 has little effect on the parent particle triboelectric charge, although it makes the A-zone triboelectric charge the correct sign. BONTRON E84 has a more significant effect, especially at the high level (7%), which increases the B-zone triboelectric charge up to about 10 μC/g. The Formula II internal charge control agent further increases the triboelectric charge to between 15 and 17 μC/g in B-zone, to a level very near that of the cyan parent particle (18 μC/g). There is also less sensitivity of the triboelectric charge to charge control agent content, and in contrast to the expected trend of increasing triboelectric charge with decreasing relative humidity (observed in the parent particles with 0% internal charge control agent toner and the particles containing the BONTRON charge control agents), the triboelectric effect is highest in A-Zone for the Formula II containing toners.

The triboelectric charges were verified for replicates of the 3% and 7% Formula II containing toners, as well as an intermediate level (5%), which were separate makes of the toners (starting at extrude) to verify the effect. In these tests, the triboelectric charges varied for the replicates within only a 0-4 μC/g range.

Figure 2:
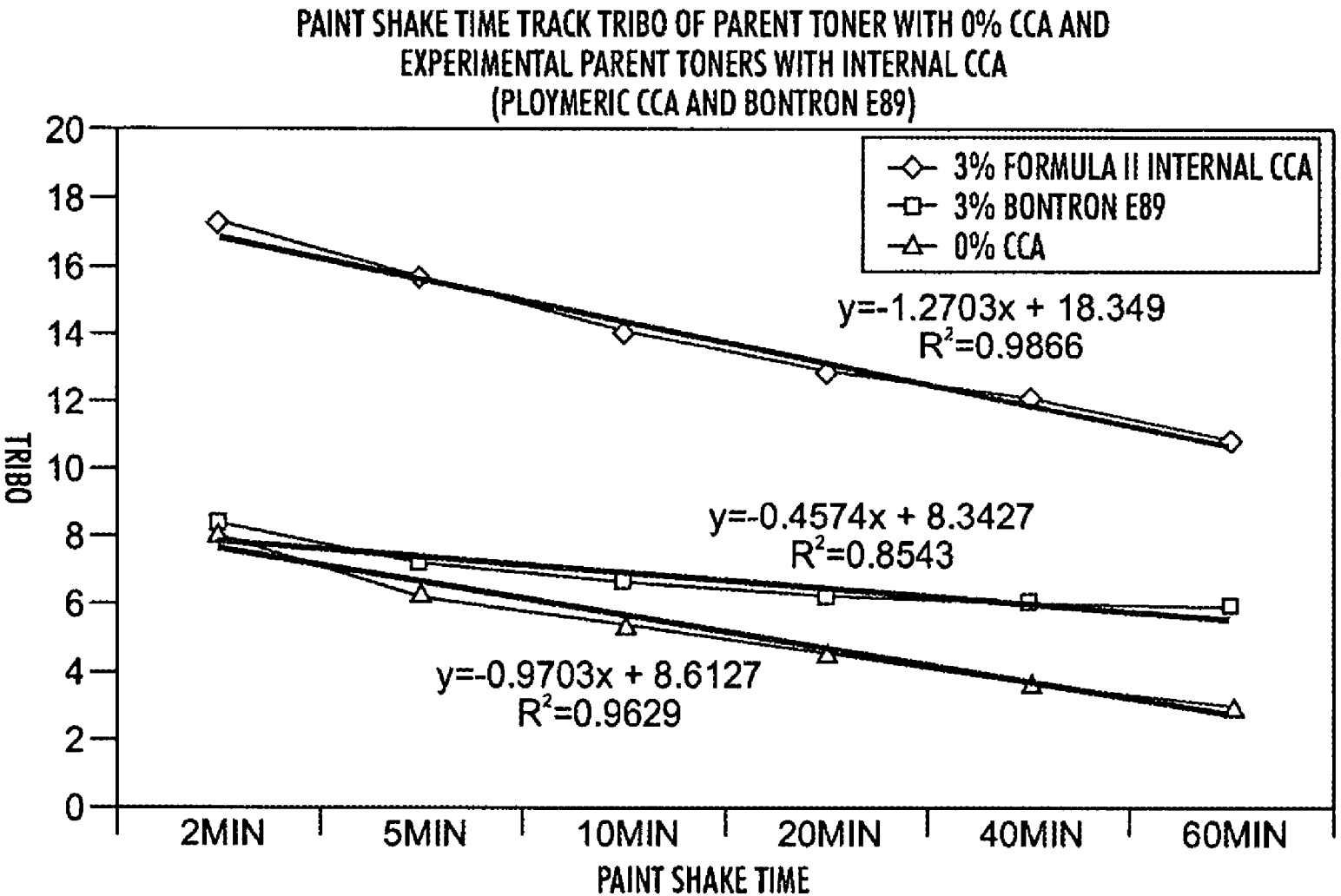
FIG. 2 is a graph of experimental data showing paint shake time track triboelectric charge of embodiments of parent toner with 0% charge control agent and experimental parent toners with internal charge control agents (including of embodiments of the present disclosure).

FIG. 2 shows the triboelectric charge differences and triboelectric charge stability of parent toner without internal charge control agent, the toner with 3% BONTRON E89, and the toner with 3% Formula II internal charge control agent as a function of paint shake aging (in B-zone). The triboelectric charge of the parent toner with 3% of the Formula II internal charge control agent decays at a somewhat faster rate compared to the other toners, but still remains about 10 μC/g higher than the parent toner without internal charge control agent after 60 minutes of paintshaking. The triboelectric charge of the parent toner with 3% BONTRON E89 has a slower rate of decay compare to the toner with Formula II internal charge control agent, but a much lower overall triboelectric charge level compared to the toner with Formula II internal charge control agent.

Figure 3:
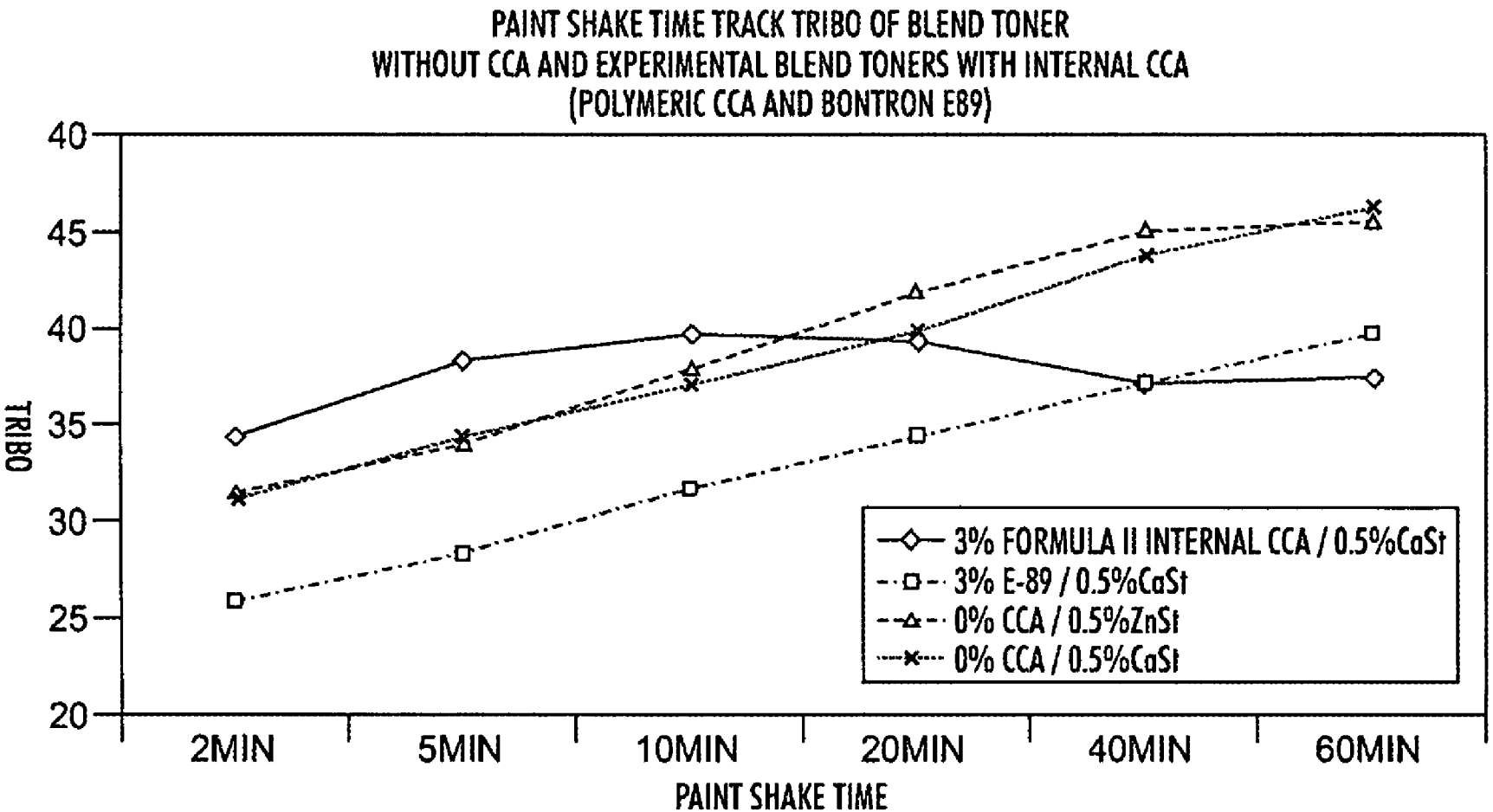
FIG. 3 is a graph of experimental data showing paint shake time track triboelectric charge of embodiments of blend toner without internal charge control agent and experimental blend toners with internal charge control agents (including of embodiments of the present disclosure).

FIG. 3 shows the triboelectric charge stability of the blend toners without internal charge control agent, with BONTRON E89, and with Formula II internal charge control agent as a function of paint shake aging (in B-zone). The triboelectric charge stability of the toner with BONTRON E89 was about 26 μc/g at 2 minutes and rose steadily to about 40 μC/g at 60 minutes. The triboelectric charge of the parent toners without internal charge control agent was about 31.5 μC/g at 2 minutes and rose fairly steadily to about 45.5 μC/g at 60 minutes. The triboelectric charge of the toner with 3% Formula II internal charge control agent was about 34.5 μC/g at 2 minutes, rose to about 38 μC/g at 5 minutes and to about 40 μC/g at 10 minutes and then declined slightly to about 39 μC/g at 20 minutes, about 37 μC/g at 40 minutes, and stayed steady at about 37 μC/g at 60 minutes. The triboelectric charge of a finished toner with 3% Formula II internal charge control agent was equivalent to that of the control toner with no internal charge control agent (at the 20 minute paintshake point, which is the standard quality control comparison point). The triboelectric charge stability of blend toner with 3% Formula II internal charge control agent, as a function of paintshake time, is substantially more stable, even though the decay rate of the triboelectric charge for the parent toner was faster than that of the control (FIG. 2). For example, as shown in FIG. 3, the triboelectric charge of the toner only varies between about 34 and 40 μC/g (for about a 6 μC/g variance), in contrast to the other shown toners which vary at least about 10 μC/g. Compared to the control toners, the triboelectric level of the 3% Formula II internal charge control toner was higher at 2 minutes (about 34.5 μC/g for the 3% Formula II internal charge control toner, as opposed to about 31.5 μC/g for the control toners) (including an overall faster charging rate) and remained approximately constant over the period of 5 to 60 minutes, whereas the control toner triboelectric charges continued to rise over the same timeframe.

Figure 4:
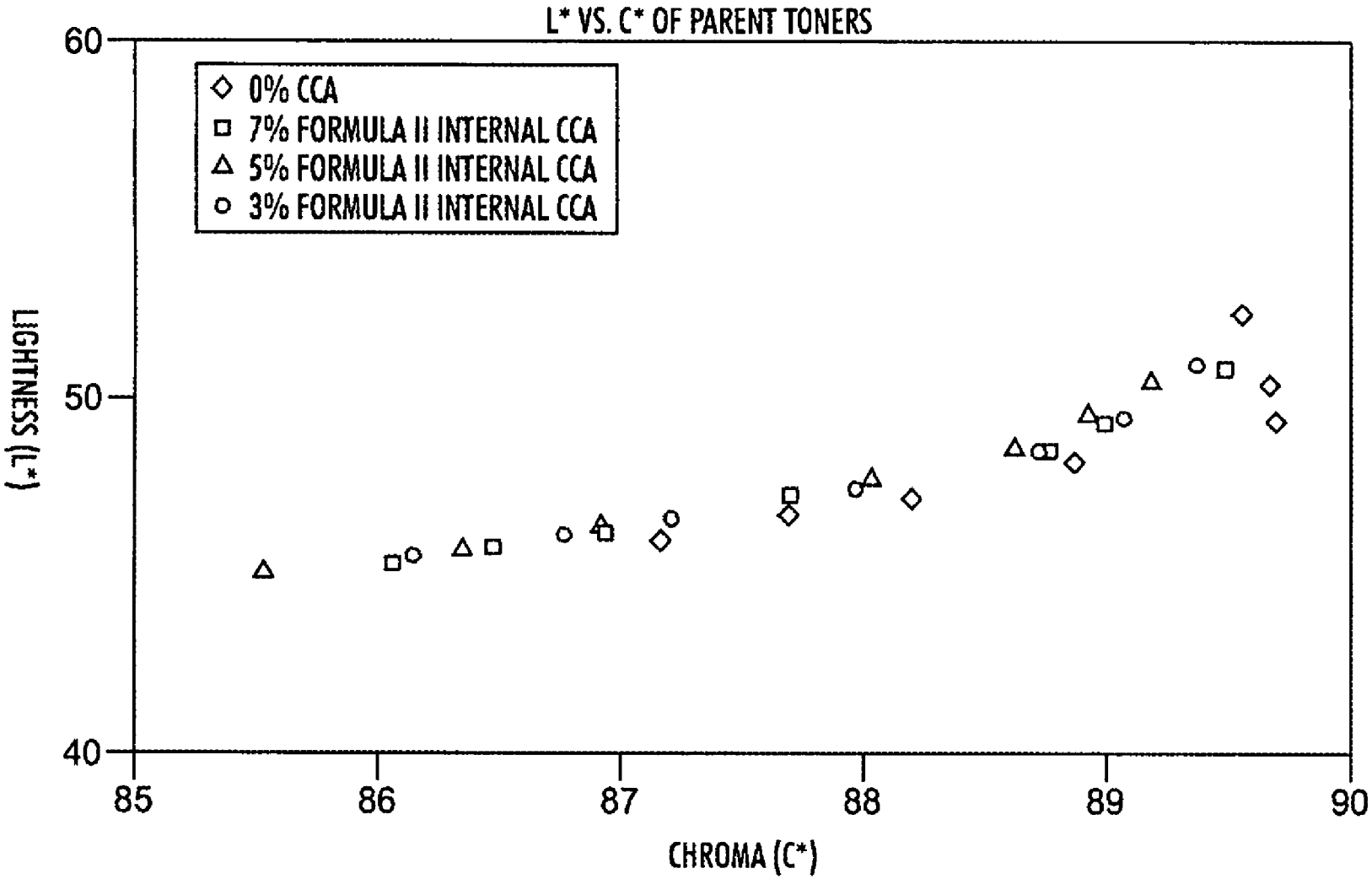
FIG. 4 is a graph of experimental data showing lightness versus chroma of embodiments of parent toners of the present disclosure.

The final response characterized is the effect of the Formula II internal charge control agent on the color of the magenta toner. That response is shown in FIG. 4 (Lightness (L*) v. Chroma (C*)). The amount of the Formula II internal charge control agent added has no effect on the toner color at any of the levels tested. The color measurements are prepared using a Wet deposition method.

A pre-weighed toner sample was dumped into the surfactant solution (Triton X-100 and Di $H_2O$) in a vial to wet the toner. After the toner had been wetted, it was sonified for 15 seconds and then poured into a 1000 ml flask and bubbles are suppressed using a squirt of methanol and topped off with Di $H_2O$.

A 47 mm acetate nitrate (mixed Esters) 0.22 micron filtration membrane was applied to a wetted sintered filtration disc and the filtration funnel was affixed to the filtration base. The appropriate amount of the wetted toner solution is poured into the filtration funnel (ex. 10 ml=10 mg/cm$^2$, 20 ml=20 mg/cm$^2$, etc.) and then a vacuum was applied and the fluid was drawn away from the toner solution until dry. The dried sample is placed in a transparency envelope and fused in an envelope fuser. The fused sample measured color gamut, L*, a*, b*, C*, h* (CIE), using an X-Rite 968.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A toner comprising:

resin;

magenta pigment; and an internal charge control agent having the formula:

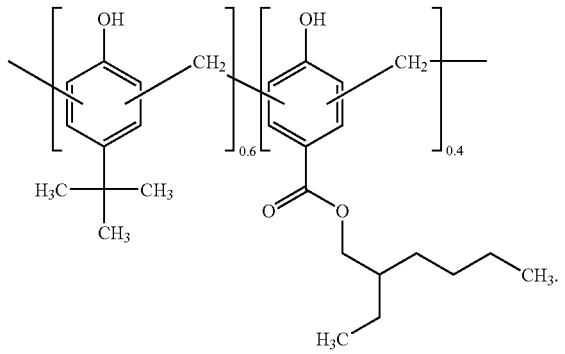

2. The toner of claim 1, wherein the magenta pigment comprises xanthene.

3. The toner of claim 1, wherein the triboelectric charge of the toner decreases when relative humidity of toner environment decreases.

4. The toner of claim 1, wherein the triboelectric charge of the toner is at least about 10 μC/g when the toner environment has a relative humidity of about 10% or more at about 70° F.

5. The toner of claim 1, wherein the triboelectric charge of the toner is at least about 15 μC/g when the toner environment has 80% relative humidity or higher at 80° F.

6. The toner of claim 1, wherein the triboelectric charge of the toner is greater than 10 μC/g when measured during at least about zero to sixty minutes of paint shake time, wherein substantially no external additives have been added to the toner.

7. The toner of claim 1, wherein the resin is selected from the group consisting of cross-linked polyester and linear polyester.

8. The toner of claim 1, wherein the charge control agent is about 3 to about 7% by weight of the toner.

9. The toner of claim 1, wherein the amount of charge control agent in the toner does not substantially affect the color of the toner as measured in lightness versus chroma.

10. A toner comprising:

resin;

magenta pigment, wherein the magenta pigment is a xanthene pigment; and an internal charge control agent having the formula:

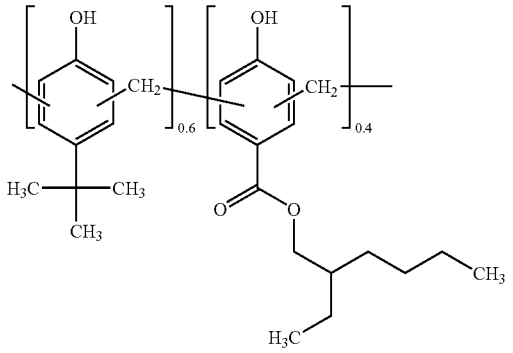

wherein the triboelectric charge of the toner is at least about 10 μC/g when the toner environment has a relative humidity of about 10% or more at about 70° F.

11. A method of making a toner comprising admixing resin, magenta pigment, and an internal charge control agent having the formula:

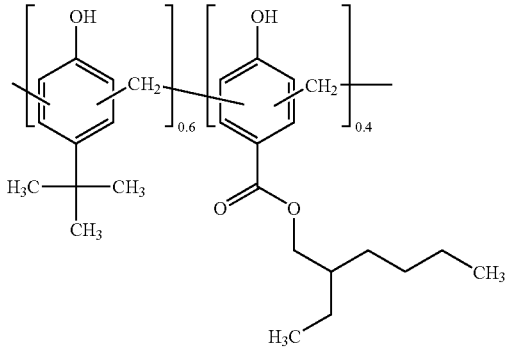

grinding the mixture; and classifying the ground mixture.

12. The method of claim 11, wherein the ground mixture is classified to a particle size of about 8.3±0.4 microns.

13. The method of claim 11, wherein the magenta pigment comprises xanthene.

14. The method of claim 11, wherein the triboelectric charge of the toner decreases when relative humidity of the toner environment decreases.

15. The method of claim 11, wherein the triboelectric charge of the toner is higher than that of the same toner without the charge control agent, wherein both toners have substantially no external additives.

16. The method of claim 11, wherein the triboelectric charge of the toner is at least about 10 μC/g when the toner environment has a relative humidity of about 10% or more at about 70° F.

17. The method of claim 11, wherein the triboelectric charge of the toner is at least about 15 μC/g when the toner environment has 80% relative humidity or higher at 80° F.

18. The method of claim 11, wherein the triboelectric charge of the toner is greater than 10 μC/g when measured during at least about zero to sixty minutes of paint shake time, wherein substantially no external additives have been added to the toner.

19. The method of claim 11, wherein the triboelectric charge is stable as the toner ages over time.

20. The method of claim 11, wherein the resin is selected from the group consisting of cross-linked polyester and linear polyester.

21. The method of claim 11, wherein the charge control agent is about 3 to about 7% by weight of the toner.

22. The method of claim 11, wherein the amount of charge control agent in the toner does not substantially affect the color of the toner as measured in lightness versus chroma.

* * * * *